US008057604B2

(12) United States Patent
Behrens et al.

(10) Patent No.: US 8,057,604 B2
(45) Date of Patent: Nov. 15, 2011

(54) METHOD AND DEVICE FOR DESCALING METAL STRIP

(75) Inventors: Holger Behrens, Erkrath (DE); Rolf Brisberger, Spielberg (AT); Klaus Frommann, Düsseldorf (DE); Matthias Kretschmer, Köln (DE); Rüdiger Zerbe, Neuss (DE); Evgeny Stepanovich Senokosov, St. Petersburg (RU); Andrei Evgenievich Senokosov, St. Petersburg (RU)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 579 days.

(21) Appl. No.: 11/886,397

(22) PCT Filed: Mar. 16, 2006

(86) PCT No.: PCT/EP2006/002429

§ 371 (c)(1),
(2), (4) Date: Sep. 14, 2007

(87) PCT Pub. No.: WO2006/097311

PCT Pub. Date: Sep. 21, 2006

(65) Prior Publication Data

US 2008/0190449 A1 Aug. 14, 2008

(30) Foreign Application Priority Data

Mar. 17, 2005 (DE) ..... 10 2005 012 296

(51) Int. Cl.
*C25F 1/00* (2006.01)

(52) U.S. Cl. ..... 134/1.1; 134/2; 134/15; 134/18; 134/32

(58) Field of Classification Search ..... None
See application file for complete search history.

(56) References Cited

U.S. PATENT DOCUMENTS

| | | | | |
|---|---|---|---|---|
| 4,705,579 | A | 11/1987 | Fujii | |
| 6,099,667 | A | 8/2000 | Vanden Brande et al. | |
| 2004/0026385 | A1 * | 2/2004 | Koulik et al. | 219/121.36 |
| 2006/0108034 | A1 * | 5/2006 | Frommann et al. | 148/565 |

FOREIGN PATENT DOCUMENTS

| | | |
|---|---|---|
| JP | 3120346 | 5/1991 |
| JP | 4297561 | 10/1992 |
| JP | 5105941 | 4/1993 |
| JP | 6088184 | 3/1994 |
| JP | 6248355 | 9/1994 |
| JP | 6279842 | 10/1994 |
| JP | 6336662 | 12/1994 |

(Continued)

OTHER PUBLICATIONS

Patent Abstracts of Japan, BD. 1995, No. 01, Feb. 28, 1995 & JP 06 279842 A (Mitsubishi Heavy Ind Ltd), Oct. 4, 1994, English abstract only.

(Continued)

*Primary Examiner* — Michael Kornakov
*Assistant Examiner* — Eric Golightly
(74) *Attorney, Agent, or Firm* — Lucas & Mercanti, LLP; Klaus P. Stoffel

(57) ABSTRACT

A method and a device for descaling a metal strip, in which the metal strip is guided in a direction of conveyance through at least one plasma descaling unit in which it is subjected to a plasma descaling. The metal strip is subjected to an automatically controlled cooling process in a cooling unit following the plasma descaling in the one or more plasma descaling units in such a way that it has a well-defined temperature downstream of the cooling unit.

9 Claims, 3 Drawing Sheets

FOREIGN PATENT DOCUMENTS

| | | |
|---|---|---|
| JP | 7132316 | 5/1995 |
| JP | 2001140051 | 5/2001 |
| RU | 2 145 912 | 2/2000 |
| WO | 01/09410 | 2/2001 |
| WO | 02/090624 | 11/2002 |
| WO | 2004/044257 | 5/2004 |
| WO | 2004044257 | 5/2004 |

OTHER PUBLICATIONS

Patent Abstracts of Japan, BD. 017, No. 458, Aug. 20, 1993 & JP 05 105941 A (Nippon Steel Corp), Apr. 27, 1993, English abstract only.

Patent Abstracts of Japan, BD. 018, No. 647, Dec. 8, 1994 & JP 06 248355 (Kawasaki Steel Corp), Sep. 6, 1994, English abstract only.

Patent Abstracts of Japan, BD. 2000, No. 22, Mar. 9, 2001 & JP 2001 140051 A (Kawasaki Steel Corp), May 22, 2001, English abstract only.

Patent Abstracts of Japan, BD. 1995, No. 08, Sep. 29, 1995 & JP 07 132316 A (Kawasaki Steel Corp), May 23, 1995, English abstract only.

Patent Abstracts of Japan, BD. 015, No. 317, Aug. 13, 1991 & JP 03 120346 A (NKK Corp), May 22, 1991, English abstract only.

* cited by examiner

METHOD AND DEVICE FOR DESCALING METAL STRIP

BACKGROUND OF THE INVENTION

The invention concerns a method for descaling a metal strip, especially a hot-rolled strip of normal steel or a hot-rolled or cold-rolled strip of austenitic or ferritic stainless steel, in which the metal strip is guided in a direction of conveyance through at least one plasma descaling unit, in which it is subjected to a plasma descaling. The invention also concerns a device for descaling a metal strip.

Steel strip must have a scale-free surface before it can be further processed, e.g., by cold rolling, by the application of a metallic coating, or by direct working into a finished product. Therefore, the scale that forms, for example, during hot rolling and the subsequent cooling phase must be completely removed. In previously known methods, this is accomplished by a pickling process, in which, depending on the grade of steel, the scale, which consists of various iron oxides (FeO, $Fe_3O_4$, $Fe_2O_3$) or, in the case of stainless steels, of chromium-rich iron oxides, is dissolved by means of various acids (e.g., hydrochloric acid, sulfuric acid, nitric acid, or mixed acid) at elevated temperatures by chemical reaction with the acid. Before the pickling operation, an additional mechanical treatment by stretcher-and-roller leveling is necessary in the case of normal steel to break up the scale to allow faster penetration of the acid into the layer of scale. In the case of stainless, austenitic, and ferritic steels, which are much more difficult to pickle, an annealing operation and a preliminary mechanical scaling operation must be performed on the strip before the pickling process is carried out in order to produce a strip surface that can be pickled as well as possible. After the pickling operation, to prevent oxidation, the steel strip must be rinsed, dried, and, depending on requirements, oiled. The pickling of steel strip is carried out in continuous lines, whose process section can be very long, depending on the strip speed. Therefore, installations of this type require very large investments. In addition, the pickling process uses a tremendous amount of power and entails great expense for the elimination of wastewater and the regeneration of the hydrochloric acid, which is the type of acid usually used for normal steel.

Due to these disadvantages, the prior art also includes various approaches for accomplishing the descaling of metal strands without the use of acids. Previous developments along these lines are generally based on mechanical removal of the scale (e.g., the Ishiclean method, the APO method). However, with respect to their economy and the quality of the descaled surface, methods of these types are not suitable for the industrial descaling of wide steel strip. Therefore, acids continue to be used for descaling this type of strip.

Consequently, so far it has been necessary to accept the disadvantages with respect to economy and environmental pollution.

Recent approaches to the descaling of metal strands have been based on plasma technology. Methods and devices of the aforementioned type for descaling metal strands with different geometries, for example, metal strip or metal wire, are already well known in various forms in the prior art. Reference is made, for example, to WO 2004/044257 A1, WO 2000/056949 A1 and RU 2 145 912 C1. In the plasma descaling technology disclosed in the cited documents, the material to be descaled runs between special electrodes located in a vacuum chamber. The descaling is effected by the plasma produced between the steel strip and the electrodes, and the result is a bare metallic surface with no residue. Plasma technology thus represents an economical, qualitatively satisfactory and environmentally friendly possibility for descaling and cleaning steel surfaces. It can be used for normal steel as well as for stainless, austenitic, and ferritic steels. No special pretreatment is necessary.

In plasma descaling, the strip thus runs through a vacuum chamber between electrodes arranged above and below the strip. The plasma is located between the electrodes and the surface of the strip on both sides of the strip. The action of the plasma on the scale results in the removal of the oxides on the surface of the strip, and this is associated with an increase in the temperature of the strip, which can be a serious disadvantage. The temperature increase can result in the formation of an oxide film on the surface of the strip when the descaled strip emerges from the vacuum and enters the air. An oxide film is unacceptable for further processing steps, such as cold rolling or the direct working of hot strip.

Various proposals have been made to improve this situation by cooling the metal strip following the plasma descaling. Methods of this type are disclosed, for example, in JP 07132316 A, JP 06279842 A, JP 06248355 A, JP 0312034, JP 2001140051 A, and JP 05105941 A. However, the concepts disclosed in this literature are aimed at cooling measures that are associated with considerable disadvantages in some cases or are relatively inefficient. For example, a cooling medium is sprayed, which makes it necessary to carry out a subsequent drying of the metal strip. If the metal strip is treated with a cooling gas, the cooling rate is very low, and, in addition, a solution of this type is not possible in a vacuum. The other proposed solutions offer almost no possibility of realizing a specific temperature program for the metal strip.

For most applications, controlled cooling of the metal strip during or after the descaling is necessary before the strip comes into contact with air. Systematic cooling of this type is not possible with the prior-art solutions.

SUMMARY OF THE INVENTION

Therefore, the objective of the invention is to create a method and a corresponding device for descaling a metal strip, with which it is possible to achieve increased quality during the production of the metal strip by, above all, preventing oxidation processes without having a negative effect on the microstructure of the metal strip.

In accordance with the invention, the solution to this problem with respect to a method is characterized by the fact that, following the plasma descaling of the metal strip in one or more plasma descaling units, the metal strip is subjected to an automatically controlled cooling in a cooling unit in such a way that it has a well-defined temperature after passing through the cooling unit.

For the purpose of achieving complete descaling, it is preferably provided that the metal strip is subjected to a plasma descaling at least twice with automatically controlled cooling after each descaling.

Oxidation of the descaled metal strip in the ambient atmosphere is prevented by carrying out the last automatically controlled cooling in the direction of conveyance in such a way that the metal strip leaves the last cooling unit in the direction of conveyance at a temperature less than or equal to 100° C.

On the other hand, there is no negative effect on the microstructure of the metal strip if the plasma descaling is carried out in each of the plasma descaling units in such a way that the metal strip has a maximum temperature of 200° C. after each plasma descaling unit.

In an especially advantageous modification of the method for cooling the metal strip, the metal strip is cooled in the one or more cooling units by bringing it into contact with a cooling roller over a predetermined angle of wrap. The cooled roller conducts heat out of the metal strip by its contact with it. To optimize the heat transfer, it has been found to be effective for the metal strip to be held under tension at least in the area of its contact with the cooling roller.

It is advantageous for the metal strip to be cooled at least essentially to the same temperature during each cooling following a plasma descaling. Alternatively or additionally, it is advantageous for the metal strip to be cooled at least essentially by the same temperature difference during each cooling following a plasma descaling.

The cooling of the metal strip in the cooling unit or units is preferably carried out at a pressure below ambient pressure and especially in a vacuum. However, it can be provided that the cooling of the metal strip in the last cooling unit in the direction of conveyance is carried out under a protective gas, especially nitrogen.

The device for descaling the metal strip has at least one plasma descaling unit, through which the metal strip is guided in the direction of conveyance. In accordance with the invention, the device is characterized by at least one cooling unit, which is installed downstream of the plasma descaling unit in the direction of conveyance and is suitable for the automatically controlled cooling of the metal strip to a well-defined temperature.

A temperature sensor is preferably installed at the end of or downstream of the cooling unit or each cooling unit in the direction of conveyance of the metal strip. The temperature sensor is connected with an automatic control unit that is suitable for controlling the cooling unit with respect to its cooling capacity and/or the speed of conveyance of the metal strip.

Preferably, at least two plasma descaling units are provided, each of which is followed by a cooling unit.

It is especially advantageous for each cooling unit to have at least three cooling rollers, which are arranged and can be moved relative to one other in such a way that the angle of wrap between the metal strip and the surface of the roller can be varied. The cooling capacity that the cooling unit applies to the metal strip, i.e., the intensity with which the cooling unit cools the metal strip, can be controlled by the variation of the angle of wrap. Therefore, means are preferably provided by which at least one cooling roller can be moved relative to another cooling roller perpendicularly to the axes of rotation of the cooling rollers.

The cooling rollers are preferably liquid-cooled and especially water-cooled.

In addition, it is possible to provide means for producing a tensile force in the metal strip, at least in the area of the cooling units. This ensures that the metal strip makes good contact with the cooling rollers.

In accordance with one plant design, at least two plasma descaling units and at least two downstream cooling units are installed in a straight line. In an alternative, space-saving design, one plasma descaling unit is installed in such a way that the metal strip is guided vertically upward (or downward) in it, and another plasma descaling unit is installed in such a way that the metal strip is guided vertically downward (or upward) in it, and a cooling unit is installed between the two plasma descaling units.

A good cooling effect of the cooling rollers can be realized if the cylindrical surfaces of the rollers have a coating made of a wear-resistant material that is a good thermal conductor, especially hard chromium or a ceramic.

The technology described above offers great advantages over pickling with respect to environmental protection, power consumption, and quality.

Furthermore, capital costs for corresponding installations are significantly lower than for previously known descaling and/or cleaning installations.

It is especially advantageous for the metal strip that is to be descaled to have a very good and nonoxidized surface after the descaling, so that the downstream operations can be carried out with high quality.

The invention thus ensures that during or after the descaling, the metal strip is cooled in a controlled way to a temperature below the temperature at which oxidation or temper color could develop on the surface of the strip in air.

In a method for descaling a metal strip, especially a hot-rolled strip made of normal steel, in which the metal strip is guided in a direction of conveyance through at least one plasma descaling unit, in which it is subjected to a plasma descaling, the plasma descaling can be followed directly or indirectly by an operation in which the metal strip is coated with a coating metal, especially by hot dip galvanizing.

In this connection, the energy introduced into the metal strip by the plasma descaling can be utilized in an advantageous way for preheating the metal strip before the coating.

The metal strip is preferably plasma descaled and then coated, especially by hot dip galvanizing, in a coupled installation. The metal strip preheated by the plasma descaling is preferably guided, without exposure to air, from the plasma descaling into the protective gas atmosphere of a continuous furnace necessary for the coating, in which the strip is further heated to the temperature required for the coating. In this regard, after the plasma descaling, the strip can be heated inductively by the "heat-to-coat" process. The strip, especially hot-rolled strip that is to be galvanized, can be heated very quickly under reduced atmosphere to 440° C. to 520° C., especially about 460° C., before it enters the coating bath.

The coating operation downstream of the plasma descaling can be carried out by the conventional method with a guide roller in the coating tank or by the vertical process (Continuous Vertical Galvanizing Line (CVGL) process), in which the coating metal is retained in the coating tank by an electromagnetic seal. The metal strip is immersed in the coating metal for only a very short time.

The plasma descaling installation can be coupled with a continuous furnace for the hot dip galvanizing of hot-rolled steel strip, such that a vacuum lock can be located on the exit side of the plasma descaling unit and a furnace lock of a standard design can be located on the entry side of the continuous furnace, which have a gastight connection with each other.

The latter coupling of the plasma descaling unit and the coating unit has special advantages, because hot-rolled steel strip must be completely free of oxides before the hot dip galvanizing in order for a strongly adherent zinc coating to be produced.

Furthermore, the strip must be heated to a temperature of about 460° C. to 650° C., depending on the heating rate. In this regard, the heating of the strip caused by the plasma descaling can be utilized as preheating of the strip before the strip enters the continuous furnace, which makes it possible to save energy and reduce the length of the furnace.

The drawings illustrate specific embodiments of the invention.

DETAILED DESCRIPTION OF THE INVENTION

Figure 1:
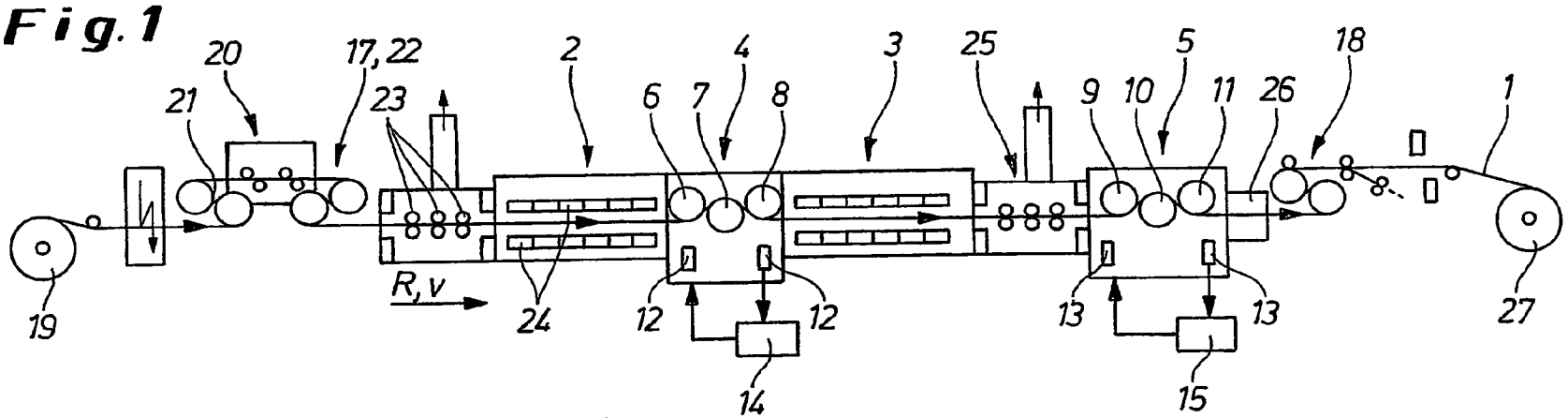
FIG. 1 shows a schematic side view of a first embodiment of a device for descaling a metal strip.

FIG. 1 shows a device for descaling a steel strip 1. This installation has a horizontal design. The steel strip 1 is unwound from a pay-off reel 19 and leveled in a stretcher-and-roller leveling machine 20 with the associated bridles 21 and 22, so that the metal strip 1 has the greatest possible flatness before the strip enters the process section of the plant under high tension.

The strip 1 passes through several vacuum locks 23 and into a first plasma descaling unit 2, in which the vacuum necessary for the plasma descaling is produced and maintained by vacuum pumps, of known design. Electrodes 24 are installed in the plasma descaling unit 2 on both sides of the strip 1 and produce the plasma necessary for the descaling.

The plasma causes the surface of the strip to be heated on both sides, which can lead to heating of the entire cross section of the strip to a temperature of a maximum of 200° C. at the end of the plasma descaling unit 2. The degree of heating of the strip over its entire cross section depends, at constant energy of the plasma, mainly on the speed of conveyance "v" of the metal strip 1 and on the thickness of the strip, with strip heating decreasing with increasing strip speed "v" and strip thickness.

The not yet completely descaled strip 1 runs from the plasma descaling unit 2 into a cooling unit 4, which is equipped with cooling rollers 6, 7, 8. The cooling unit 4 has a gastight connection with the plasma descaling unit 2, and the same vacuum prevails in the cooling unit 4 as in the plasma descaling unit 2.

The strip 1 passes around the cooling rollers 6, 7, 8, whose peripheral regions are cooled from the inside with water, which removes the heat via a coolant circulation. The high strip tension causes the strip 1 to make good contact with the cooling rollers 6, 7, 8 as it wraps around them in order to ensure the greatest possible heat transfer.

The metal strip 1 alternately wraps around the cooling rollers 6, 7, 8 from above and below. There are preferably three to seven cooling rollers. The cooling water for cooling the cooling rollers is continuously supplied and removed through rotary feed-throughs.

In the system illustrated in FIG. 1, the cooling unit 4 has three cooling rollers 6, 7, 8, which are separately driven. Depending on the cooling capacity and the maximum strip speed "v" of the installation, more cooling rollers would be possible and useful. Temperature sensors 12 for continuous measurement of the temperature of the metal strip 1 are located on the entry side and the exit side of the cooling unit 4 The angle of wrap α (see FIGS. 3 and 4) and thus the intensity of cooling of the metal strip 1 by the cooling unit 4 can be controlled by adjusting one (or more) of the cooling rollers 6, 7, 8 (see FIGS. 3 and 4), for example in the vertical direction. At the end of the cooling unit 4, the maximum strip temperature should be about 100° C.

The cooled strip 1 runs from the cooling unit 4 into a second plasma descaling unit 3, which has a gastight connection with the cooling unit 4 and in which vacuum pumps produce the same vacuum as in the first plasma descaling unit 2. The descaling of the strip 1, which was still incomplete after the first descaling unit 2, is completed in the second plasma descaling unit 3, which is constructed similarly to the first. As in the case of the first plasma descaling unit 2, during its passage through the second plasma descaling unit 3, the strip 1 is heated to an end temperature that is about 100° C. to 200° C. above the temperature at which it enters the second plasma descaling unit 3, depending on the strip speed "v" and on the cross-sectional area of the strip. When it leaves the plasma descaling unit 3, the strip 1 passes through a gastight lock 25 and into a second cooling unit 5, which is filled with a protective gas (e.g., nitrogen) and, like the first cooling unit 4, is equipped with cooling rollers 9, 10, 11.

The individual plasma descaling units 2 and 3 and any additional units of this type are preferably all of the same length.

The number of cooling rollers 6, 7, 8, 9, 10, 11 depends on the capacity of the installation. In cooling unit 5, the cooling rollers 9, 10, 11 cool the strip 1 to a final temperature that does not exceed 100° C. As in the case of the first cooling unit 4, temperature sensors 13 for measuring the strip temperature are located on the entry side and the exit side of the cooling unit 5. At the end of the cooling unit 5, there is another gastight lock 26 that prevents air from entering the cooling unit 5. This measure ensures that the strip 1 leaves the process section of the line at a maximum temperature of 100° C. and that the bare surface of the strip cannot be oxidized by atmospheric oxygen.

The process section of the installation is followed by a tension bridle 18 that consists of two or three rolls and applies the necessary strip tension or, together with the bridle 22, maintains the necessary strip tension. The elements labeled 17 and 18 thus constitute means for producing a tensile force in the strip 1. The tensile force produced in the strip 1 serves to ensure good contact between the strip 1 and the cooling rollers 6, 7, 8, 9, 10, 11. The strip 1 then runs through additional necessary units, such as a strip accumulator and trimming shear, to the coiler 27 (as shown) or to other coupled units, e.g., to a tandem mill.

Depending on the calculated required cooling capacity, the proposed plasma descaling installation can have one or more plasma descaling units 2, 3 followed by cooling units 4, 5. The specific embodiment according to FIG. 1 has two of these units. If only one cooling unit 4 is used, then it is designed similarly to the second cooling unit 5 described here with the locks 25 and 26 associated with the second cooling unit 5.

Figure 2:
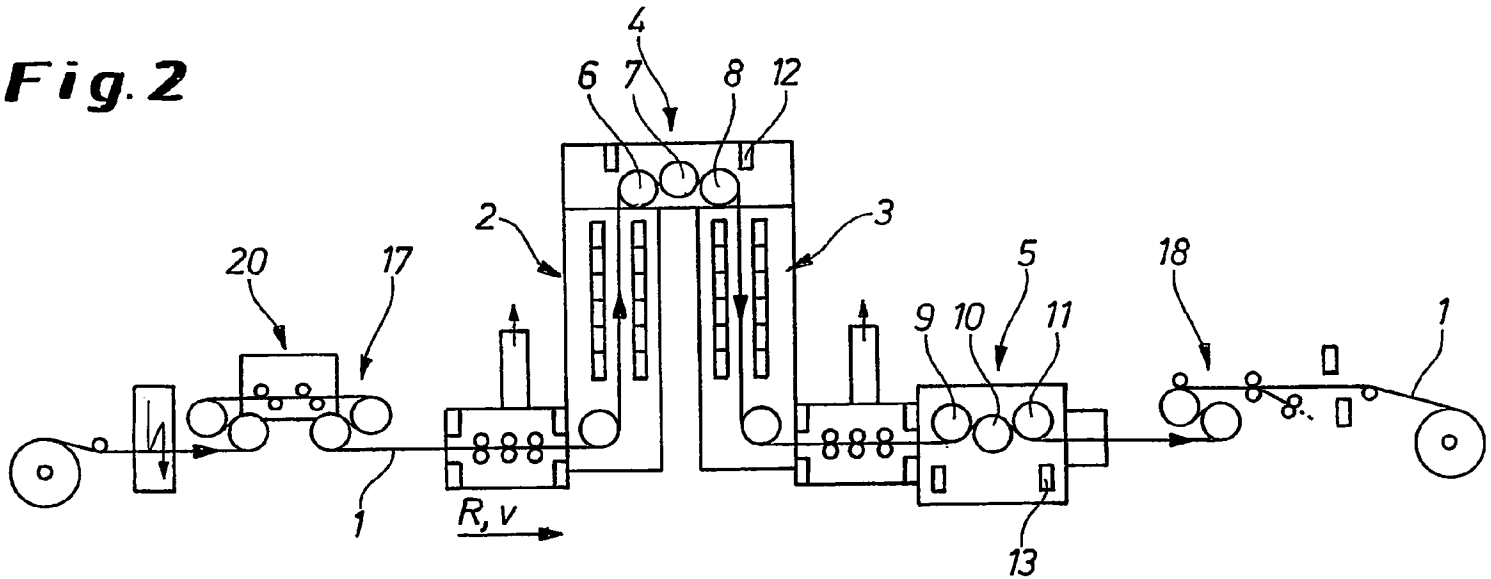
FIG. 2 shows a view similar to FIG. 1 of a second embodiment of the device.

FIG. 2 shows an alternative embodiment of the installation for descaling steel strip 1, in which the plasma descaling units 2 and 3 are arranged vertically. All of the operations in this installation are identical with those of the installation explained in connection with FIG. 1. A vertical arrangement can be more advantageous under certain conditions than a horizontal arrangement due to its shorter overall length.

Figure 4:
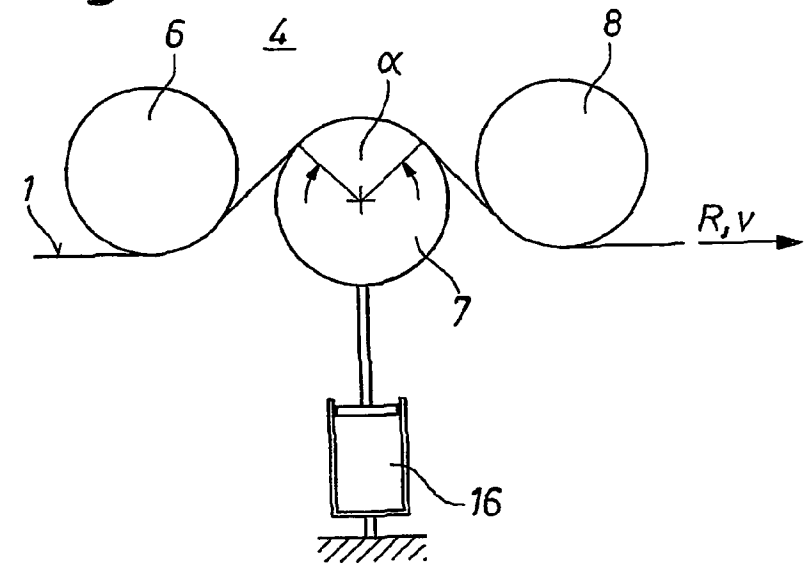
FIG. 4 is a drawing analogous to FIG. 3 of the cooling unit at high cooling capacity.
Figure 3:
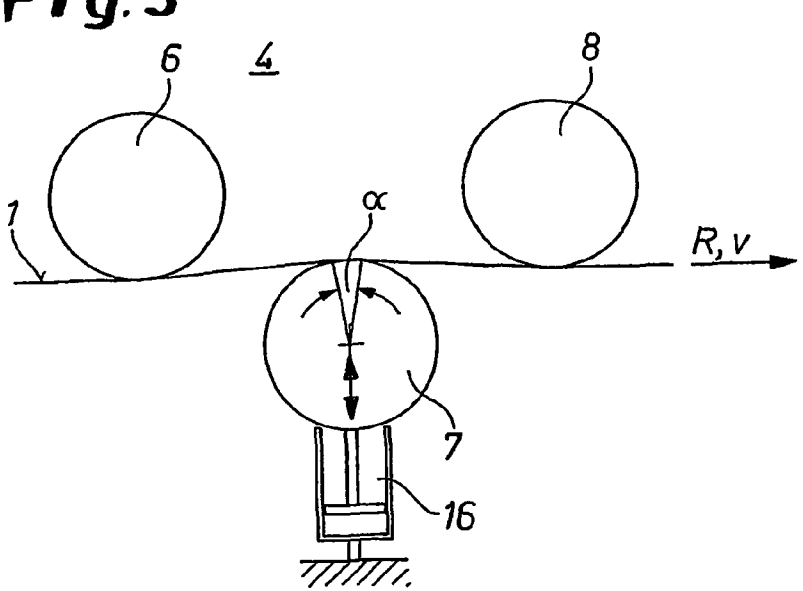
FIG. 3 is a schematic drawing of three cooling rollers of a cooling unit at low cooling capacity.

FIGS. 3 and 4 show that the angle of wrap α of the strip 1 around the rollers 6, 7, 8 (recorded here for the angle of wrap around the roller 7) can be varied by vertical displacement of the cooling roller 7 (see double arrow), which is positioned between the two cooling rollers 6 and 7, so that the heat flow from the metal strip 1 to the cooling rollers 6, 7, 8 also varies. The middle cooling roller 7 is vertically displaced by moving means 16, which are shown schematically and in the present case are designed as a hydraulic piston-cylinder system.

Measurement of the strip temperature in or at the end of the cooling units 4, 5 by the temperature sensors 12, 13 makes it possible to control the cooling capacity in the cooling units 4, 5 via automatic control units 14 and 15, which are shown only in a highly schematic way in FIG. 1, so that a desired exit temperature of the strip 1 can be realized. If the measured temperature is too high, a higher angle of wrap α can be adjusted by driving the moving means 16, so that the strip 1 is more intensely cooled. In principle, it is also possible to increase or decrease the speed of conveyance "v" of the strip 1 through the installation in order to decrease or increase the cooling effect. Of course, this then requires coordination between the two automatic control units 14 and 15.

Figure 5:
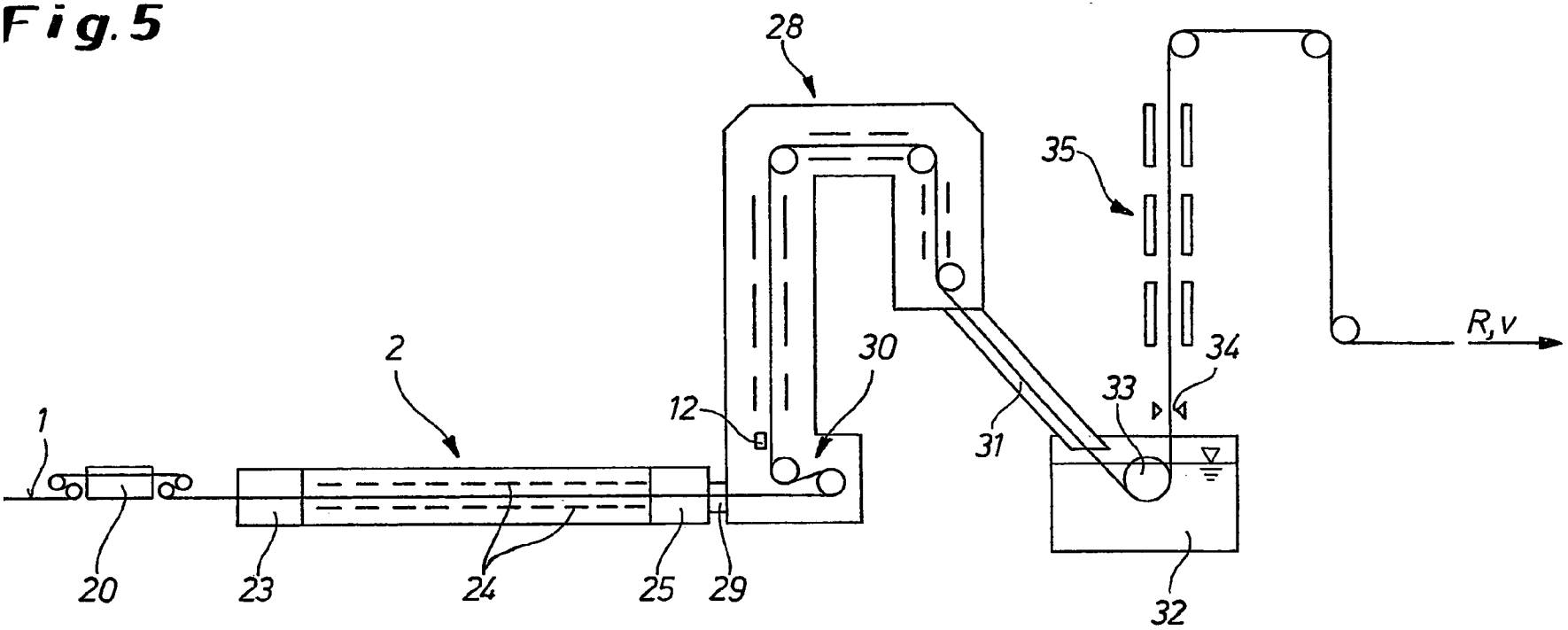
FIG. 5 shows a schematic side view of a device for descaling the metal strip and then hot dip galvanizing it.

FIG. 5 shows a drawing of a solution in which the heat introduced into the metal strip by the plasma descaling is used to apply a coating metal to the strip immediately following the descaling. FIG. 5 shows the process section comprising a coupled plasma descaling and hot dip galvanizing line for hot-rolled steel strip. After the stretcher leveling in the stretcher-and-roller leveling machine 20 (stretcher leveling unit), the strip passes through a vacuum lock 23 and into the plasma descaling unit 2, where it is descaled and in the process is heated to about 200° C. to 300° C., depending on the strip speed and the strip thickness.

The strip 1 then passes through a vacuum exit lock 25, through the furnace entry lock 29 connected with it, and into a continuous furnace 28. On the entry side of the furnace 28, there is a pair of tension rolls 30 (hot bridle), which produces the high strip tension that is needed in the plasma descaling unit 2. Downstream of the pair of tension rolls 30, the strip temperature is measured with a temperature sensor 12, by which the amount of additional strip heating necessary in the continuous furnace 28 is automatically controlled. From the position of the sensor 12, the strip 1 passes through the inductively heated continuous furnace 28, in which it is very quickly heated to about 460° C. by the heat-to-coat process. The strip then passes through a snout 31 into the coating tank 32, in which it is hot dip galvanized. The coating thickness is controlled by stripping jets 34. The metal strip 1 is cooled in the air cooling line 35 which follows. It is then sent through additional necessary processing steps, for example, temper rolling, stretcher leveling, and chromating.

LIST OF REFERENCE SYMBOLS

1 metal strip
2 plasma descaling unit
3 plasma descaling unit
4 cooling unit
5 cooling unit
6 cooling roller
7 cooling roller
8 cooling roller
9 cooling roller
10 cooling roller
11 cooling roller
12 temperature sensor
13 temperature sensor
14 automatic control unit
15 automatic control unit
16 moving means
17 means for producing a tensile force
18 means for producing a tensile force
19 pay-off reel
20 stretcher-and-roller leveling machine
21 bridle
22 bridle
23 vacuum lock
24 electrodes
25 lock
26 lock
27 coiler
28 continuous furnace
29 furnace entry lock
30 pair of tension rolls
31 snout
32 coating tank
33 guide roller
34 stripping jets
35 air cooling line
R direction of conveyance
α angle of wrap
v conveyance speed

The invention claimed is:

1. A method for descaling a metal strip (1), in which the metal strip (1) is guided in a direction of conveyance (R) through at least two plasma descaling units (2, 3), in which it is subjected to a plasma descaling, where, following the plasma descaling of the metal strip (1) in a first of the plasma descaling units (2, 3), the metal strip (1) is subjected to an automatically controlled cooling in a first cooling unit (4, 5) in such a way that it has a well-defined temperature after passing through the first cooling unit (4, 5), wherein the metal strip (1) is cooled in the first cooling unit (4, 5) by bringing it into contact with a cooling roller (6, 7, 8, 9, 10, 11) over a predetermined angle of wrap (a), and varying the angle of wrap to control cooling of the metal strip after leaving the first cooling unit the metal strip is subjected to plasma descaling in a last descaling unit, after leaving the last descaling unit the metal strip is cooled in a last cooling unit using a protective gas.

2. The method in accordance with claim 1, wherein the metal strip (1) is subjected to a plasma descaling at least twice with automatically controlled cooling after each descaling.

3. The method in accordance with claim 1, wherein the last automatically controlled cooling in the direction of conveyance (R) is carried out in such a way that the metal strip (1) leaves the last cooling unit (5) in the direction of conveyance (R) at a temperature of less than or equal to 100° C.

4. The method in accordance with claim 1, wherein the plasma descaling is carried out in each of the plasma descaling units (2, 3) in such a way that the metal strip (1) has a maximum temperature of 200° C. after each plasma descaling unit (2, 3).

5. The method in accordance with claim 1, wherein the metal strip (1) is held under tension at least in the area of its contact with the cooling roller (6, 7, 8, 9, 10, 11),

6. The method in accordance with claim 2, wherein the metal strip (1) is cooled at least essentially to the same temperature during each cooling following a plasma descaling.

7. The method in accordance with claim 2, wherein the metal strip (1) is cooled at least essentially by an equal temperature difference between the temperature of the strip and the temperature of the cooling to which the strip is subjected during each cooling following a plasma descaling.

8. The method in accordance with claim 1, wherein the cooling of the metal strip (1) in the cooling unit or units (4, 5) is carried out at a pressure below ambient pressure.

9. The method in accordance with claim 1, wherein the cooling of the metal strip (1) in the last cooling unit (5) in the direction of conveyance (R) is carried out under a protective gas.

* * * * *